US008439167B2

(12) United States Patent
Kocher et al.

(10) Patent No.: US 8,439,167 B2
(45) Date of Patent: May 14, 2013

(54) SPACING CONTROL FOR TWO ELEVATOR CARS IN A COMMON SHAFT

(75) Inventors: Hans Kocher, Udligenswil (CH); Jan André Wurzbacher, Zurich (CH)

(73) Assignee: Inventio AG, Hergiswil (CH)

( * ) Notice: Subject to any disclaimer, the term of this patent is extended or adjusted under 35 U.S.C. 154(b) by 304 days.

(21) Appl. No.: 12/809,825

(22) PCT Filed: Dec. 8, 2008

(86) PCT No.: PCT/EP2008/066992
§ 371 (c)(1),
(2), (4) Date: Sep. 22, 2010

(87) PCT Pub. No.: WO2009/080478
PCT Pub. Date: Jul. 2, 2009

(65) Prior Publication Data

US 2011/0031069 A1 Feb. 10, 2011

(30) Foreign Application Priority Data

Dec. 21, 2007 (EP) ..... 07124008

(51) Int. Cl.
*B66B 9/00* (2006.01)

(52) U.S. Cl.
USPC ..... 187/249; 187/391

(58) Field of Classification Search ..... 187/247, 187/249, 391–394
See application file for complete search history.

(56) References Cited

U.S. PATENT DOCUMENTS

| | | | | |
|---|---|---|---|---|
| 1,805,227 | A | 5/1931 | Rugg | |
| 5,274,203 | A * | 12/1993 | Skalski et al. | 187/393 |
| 5,306,882 | A * | 4/1994 | Gerwing et al. | 187/394 |
| 5,509,505 | A * | 4/1996 | Steger et al. | 187/394 |
| 6,062,344 | A * | 5/2000 | Okabe et al. | 187/249 |
| 6,435,315 | B1 * | 8/2002 | Zaharia | 187/394 |
| 7,178,635 | B2 * | 2/2007 | Meissner et al. | 187/249 |
| 7,353,912 | B2 * | 4/2008 | Reuter et al. | 187/249 |
| 7,353,914 | B2 * | 4/2008 | Deplazes | 187/313 |
| 7,441,631 | B2 * | 10/2008 | Oh et al. | 187/394 |
| 7,448,471 | B2 * | 11/2008 | Nuebling | 187/286 |
| 8,136,635 | B2 * | 3/2012 | Christy et al. | 187/249 |
| 8,230,977 | B2 * | 7/2012 | Thumm et al. | 187/247 |
| 2011/0005867 | A1 * | 1/2011 | Kocher | 187/249 |

FOREIGN PATENT DOCUMENTS

| | | | |
|---|---|---|---|
| EP | 1526104 | A1 | 4/2005 |
| EP | 1562848 | A1 | 8/2005 |
| EP | 1562828 | B1 | 1/2007 |
| JP | 05132257 | A * | 5/1993 |
| WO | 2004043841 | A1 | 5/2004 |

* cited by examiner

*Primary Examiner* — Anthony Salata
(74) *Attorney, Agent, or Firm* — Fraser Clemens Martin & Miller LLC; William J. Clemens

(57) ABSTRACT

Lift system (10) with a lower lift cage (K1), an upper lift cage (K2), at least one counterweight (12), and support means (TA, TB) for supporting the lower and upper lift cages (K1, K2). The support means (TB) for supporting the lower lift cage (K1) are led downwardly in the lift shaft (11) laterally along the upper lift cage (K2). Drive means for driving the lower and upper lift cages (K1, K2) are present. Arranged at the upper lift cage (K2) is a first incremental transmitter (I1) which interacts with one of the support means (TB) and supplies information about a change in the spacing (D) between the lower and upper lift cages (K1, K2).

20 Claims, 6 Drawing Sheets

SPACING CONTROL FOR TWO ELEVATOR CARS IN A COMMON SHAFT

FIELD OF THE INVENTION

The invention relates an elevator to system with two elevator cars and with a spacing control.

BACKGROUND OF THE INVENTION

Elevator systems of this kind are known, for example from European Patent Application EP-1 562 848 A1 The elevator system described there comprises two elevator cars in a common elevator shaft, with a respective drive and with a common counterweight. Each of the elevator cars has own sensors which enable determination of the position and the speed of the elevator cars. This document is regarded as closest state of the art.

It is disadvantageous with this known system inter alia that the safety of the entire system does seem to be given, but the elevator cars themselves are allocated data of a group control device. Moreover, the system appears to be relatively costly and difficult in operation.

SUMMARY OF THE INVENTION

It is now an object of the invention to propose an elevator system of the kind stated in the introduction by which the disadvantages of the state of the art are avoided. It is also the object of the invention to propose an elevator system of the kind stated in the introduction which offers increased safety without significantly increasing the complexity of the system.

According to the invention this object is fulfilled for the elevator system with a lower elevator car, an upper elevator car, at least one counterweight, support means for supporting the lower and upper elevator cars, wherein at least one support means is led downwardly in the elevator shaft laterally along the upper elevator car, drive means for driving the lower and upper elevator cars, and a common elevator shaft in which the upper elevator car and the lower elevator car vertically move independently of one another, and wherein arranged at the upper elevator car is a first incremental transmitter which interacts with the support means for supporting the lower elevator car and supplies to the upper elevator car information about a change in the spacing between the lower and upper elevator cars.

DESCRIPTION OF THE DRAWINGS

Further details and advantages of the invention are described in the following by way of examples and with reference to the drawing, in which.

DESCRIPTION OF PREFERRED EMBODIMENTS

Figure 1:
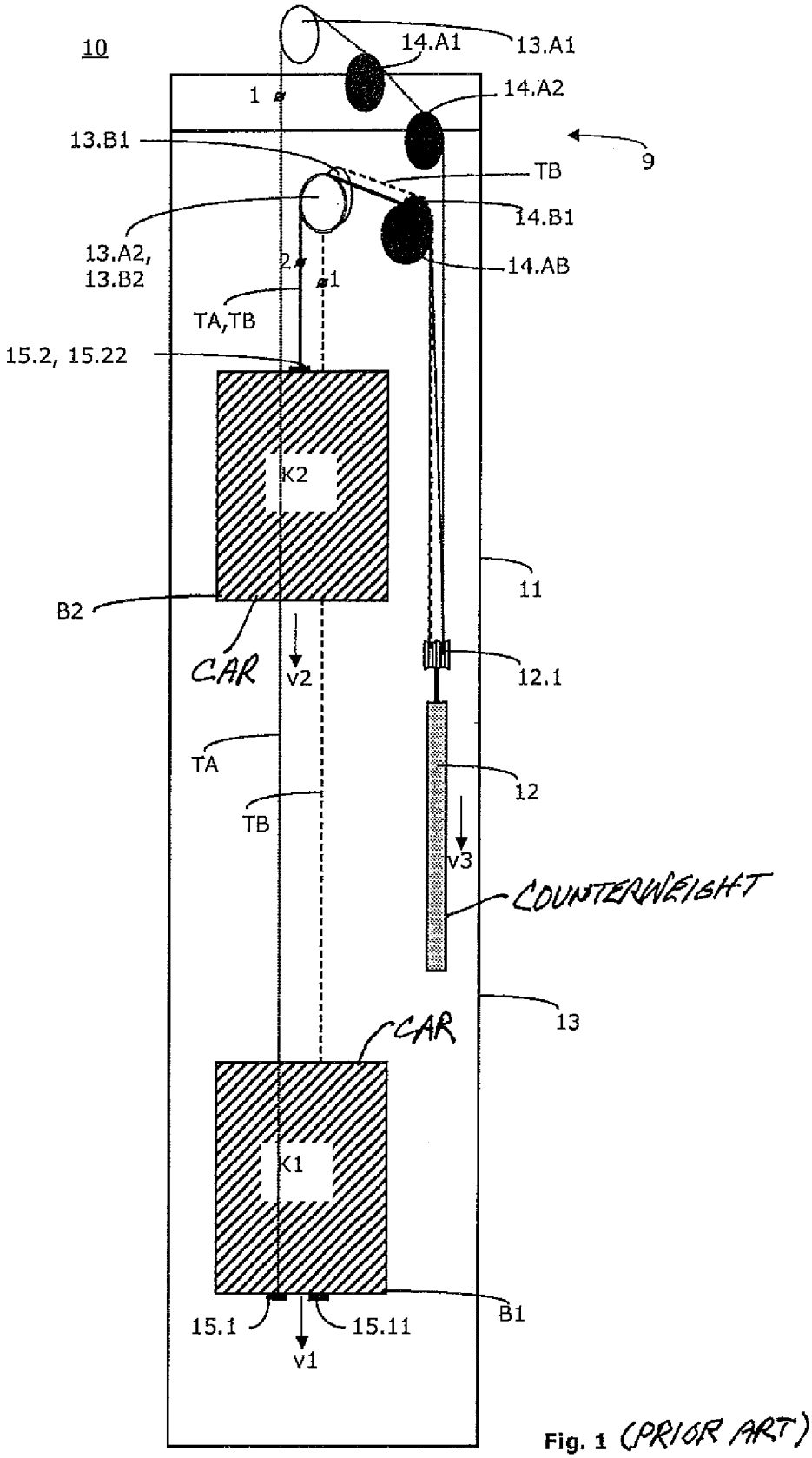
Fig. 1 (PRIOR ART)
FIG. 1 shows a first known elevator system, from the side.

The following applies generally to the drawing and the further description:

The figures are not to be considered true to scale.

Constructional elements which are the same or similar or act in the same or similar manner are provided in all figures with the same reference numerals.

Statements such as right, left, upper and lower refer to the respective arrangement in the figures.

Figure 2:
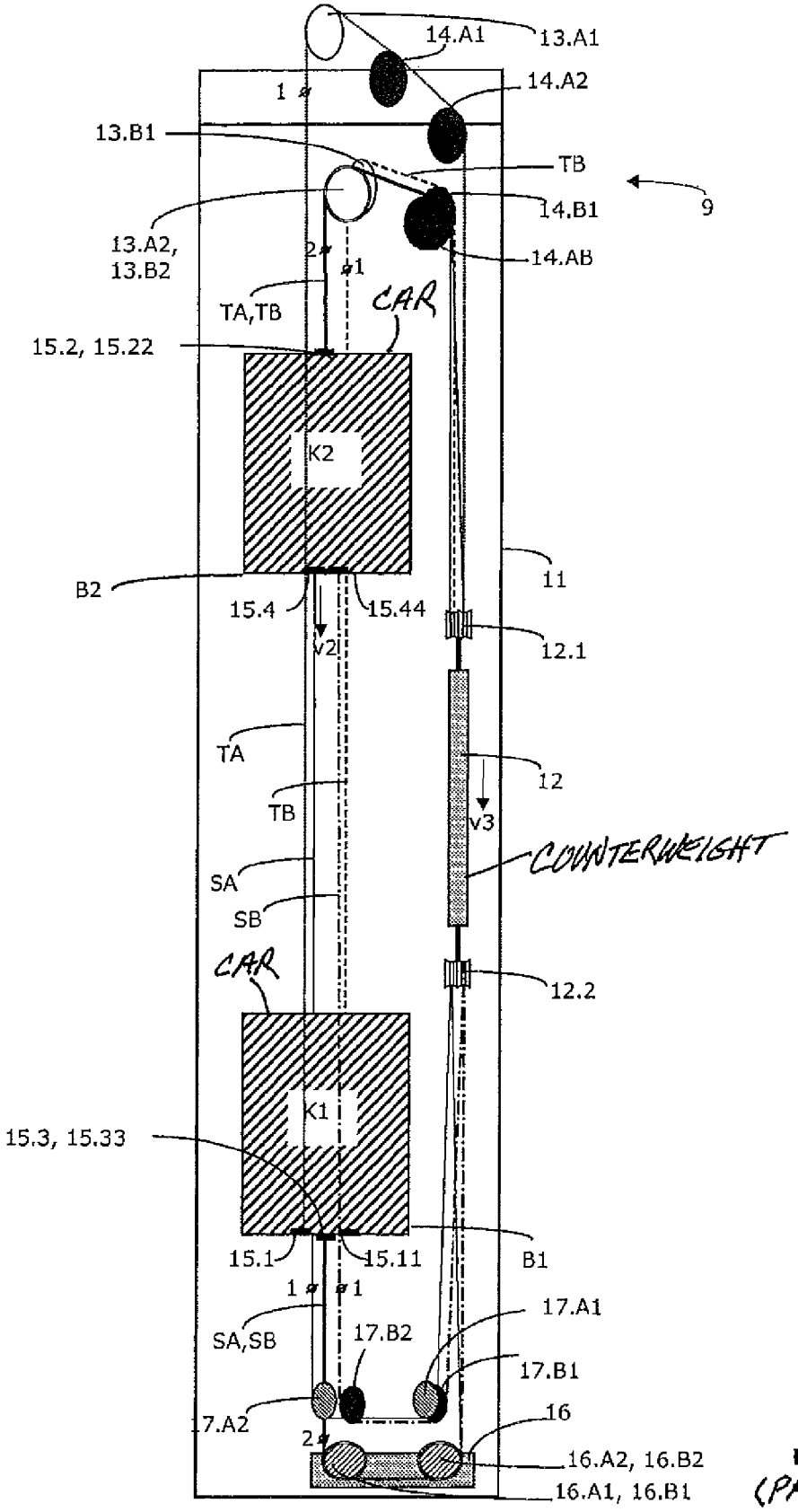
Fig. 2 (PRIOR ART)
FIG. 2 shows a second known elevator system with additional lower cables, in the same illustration as FIG. 1.

FIGS. 1 and 2 show two known elevator systems 10. These are schematic side views, on the basis of which the basic elements of such elevator systems 10 are explained.

A lower elevator car K1 and an upper elevator car K2 of the elevator system 10 are disposed one above the other in a common elevator shaft 11. In addition, a common counterweight 12 is located in the elevator shaft 11. The counterweight 12 is suspended at an upper counterweight deflecting roller arrangement 12.1 in a so-called 2:1 suspension. A roller arrangement with more than one roller is also to be understood by the expression counterweight deflecting roller. A speed of the lower elevator car K1 is indicated by v1, a speed of the upper elevator car K2 by v2 and a speed of the counterweight 12 by v3.

Drive means 9 for driving the two elevator cars K1, K2 are located in the upper region of or above the actual elevator shaft 11. The drive means 9 comprise a first drive arrangement for the lower elevator car K1 and a second drive arrangement for the upper elevator car K2. The corresponding motors are not shown in the drawings.

The first drive arrangement, which is associated the lower elevator car K1, comprises a first motor and a second motor. These motors are synchronized (for example electrically or electronically). The first motor is coupled with a first drive pulley 13.A1. The second motor is coupled with a second drive pulley 13.B1.

The second drive arrangement, which is associated with the upper elevator car K2, comprises a third motor. The third motor is coupled by way of a common shaft with a third drive pulley 13.A2 and a fourth drive pulley 13.B2, i.e. in this preferred form of embodiment a common motor for driving the two drive pulleys 13.A2 and 13.B2 is provided. However, two separate motors can also be used here.

The elevator system 10 further comprises a flexible support means TA, TB, which substantially consists of a first support means run TA and a second support means run TB. The support means runs TA and TB each have a first end and a second end. Advantageously, each of the support means runs TA and TB is formed by two or more parallel support means elements, such as, for example, by two belts or two steel cables. Each support means run TA and TB can, however, also comprise only one belt or steel cable.

In the present example the first drive pulley 13.A1 and the third drive pulley 13.A2 are associated with the first support means run TA, whilst the second drive pulley 13.B1 and the fourth drive pulley 13.B2 are associated with the second support means run TB.

In addition, the elevator system 10 comprises several deflecting rollers, in the present example a first deflecting roller 14.A1, a second deflecting roller 14.A2 for the first support means run TA, a third deflecting roller 14.B1 for the second support means TB, as well as a fourth deflecting roller 14.AB for the two support means runs TA and TB.

The lower elevator car K1 has in its lower car region B1 a first fastening region 15.1 and a second fastening region 15.11, which are arranged laterally at mutually opposite sides of the elevator car K1 (laterally balanced suspension).

The upper elevator car K2 has in its upper car region a third fastening region 15.2 and a fourth fastening region 15.22, which are arranged at least approximately centrally and which in the present example of embodiment in reality virtually coincide at 15.2/15.22 (central suspension), wherein for reasons of clarity of the drawing they are shown in FIG. 1 with a small horizontal spacing.

The support means runs TA, TB are fixed at the lateral fastening regions 15.1, 15.11 of the lower elevator car K1 as well as at the central fastening points 15.2/15.22 of the upper elevator car K2 in such a manner that each of the elevator cars K1 and K2 is suspended at both support means runs TA and TB. The elevator cars K1 and K2 are suspended at the support means TA and TB in a so-called 1:1 suspension.

The first support means run TA, starting from the first fastening point 15.1 at the lower elevator car K1, runs upwardly laterally along the elevator shaft 11. The second support means run TB, starting from the second fastening point 15.11, runs upwardly laterally along the elevator shaft 11.

FIG. 2 shows a second known elevator system 10. This comprises all constructional elements described with reference to FIG. 1 as well as an additional device so as to better tension the support means runs TA and TB and to better guide the elevator cars K1 and K2 as well as the counterweight 12.

The elevator system 10 according to FIG. 2 comprises for this purpose a lower counterweight deflecting roller 12.2 which is suspended at the counterweight 12, A fifth fastening region 15.3 and a sixth fastening region 15.33, which virtually coincide at 15.3/15.33 are centrally located at the lower region B1 of the lower elevator car K1.

A seventh fastening point 15.4 and an eighth fastening point 15.44 are laterally disposed at the lower region B2 of the upper elevator car K2 at opposite sides of the elevator car K2.

A flexible tensioning means SA, SB substantially consists of a first tensioning means run SA and a second tensioning means run SB. Each of the tensioning means runs SA and SB has a first end and a second end. These tensioning means runs SA and SB are also termed lower cable.

Moreover, several deflecting rollers are arranged in the lower region of the elevator shaft 11. Two tensioning rollers 16,A1, 16.A2 are provided for the first tensioning means run SA and two tensioning rollers 16.B1, 16.B2 for the second tensioning means run SB. In addition, two auxiliary rollers 17.A1 and 17.A2 are provided for the first tensioning means run SA and two auxiliary rollers 17.B1, 17.B2 for the second tensioning means run SB. Furthermore, a biasing arrangement 16 is provided.

The first tensioning means run SA is fastened by its first end to the central fastening region 15.3/15.33 of the lower elevator car K1 and runs from there around the tensioning rollers 16.A1 and 16.A2 to the lower counterweight deflecting roller 12.2. From the lower counterweight deflecting roller 12.2 the first tensioning means run SA runs via the deflecting rollers 17.A1 and 17.A2 to the seventh fastening region 15.4 at the upper elevator car K2, where it is fastened by its second end.

The second tensioning means run SB is fastened by its first end to the central fastening region 15.3115.33 of the lower elevator car K1 and runs from there around the tensioning rollers 16.81 and 16.B2 to the lower counterweight deflecting roller 12.2. From the lower counterweight deflecting roller 12.2 the second tensioning means run SA runs via the deflecting rollers 17.B1 and 17.B2 to the eighth fastening region 15.44 at the upper elevator car K2, where it is fastened by its second end.

In a third elevator system 10 which is slightly changed with respect to FIGS. 1 and 2 a counterweight is associated with each elevator car K1, K2. In that case the lower elevator car K1 is, as before, suspended 1:1 at two support means runs TA, TB. The support means runs TA, TB are led laterally at the upper elevator car K2 into the upper region of the elevator shaft 11 to the drive and deflecting rollers and then onward to the associated counterweight. This counterweight is fastened 1:1 in the upper region thereof to the support means runs TA, TB. The lower elevator car additionally has a lower cable which is fastened centrally to the underside, led by way of a deflecting roller arrangement in the lower region of the elevator shaft 11 to the associated counterweight and fastened 1:1 in the lower region of this counterweight.

The upper elevator car K2 is preferably suspended centrally on the upper side thereof at a further support means in 1:1 relationship. At the other end of this support means the associated counterweight is similarly suspended in 1:1 relationship. This second counterweight is preferably positioned in the elevator shaft 11 opposite the counterweight of the first elevator car K1. The support means of the upper elevator car K2 is guided by a further drive pulley and deflecting roller, which are arranged in the upper region of the elevator shaft. Analogously to the elevator system 10 of FIG. 2, the upper elevator car K2 has two lower cables SA, SB, which are fastened 1:1 in the lower region of the upper elevator car K2, and are led laterally along the lower elevator car K2 into the lower region of the elevator shaft 11. There the two lower cables are deflected by a deflecting roller arrangement to the associated counterweight, where they are fastened 1:1 to the underside of the counterweight.

All elements of the exemplifying elevator systems 10, which are shown in FIGS. 1 and 2 or described in the third elevator system 10, are used analogously in the exemplifying embodiments described in the following.

Figure 3:
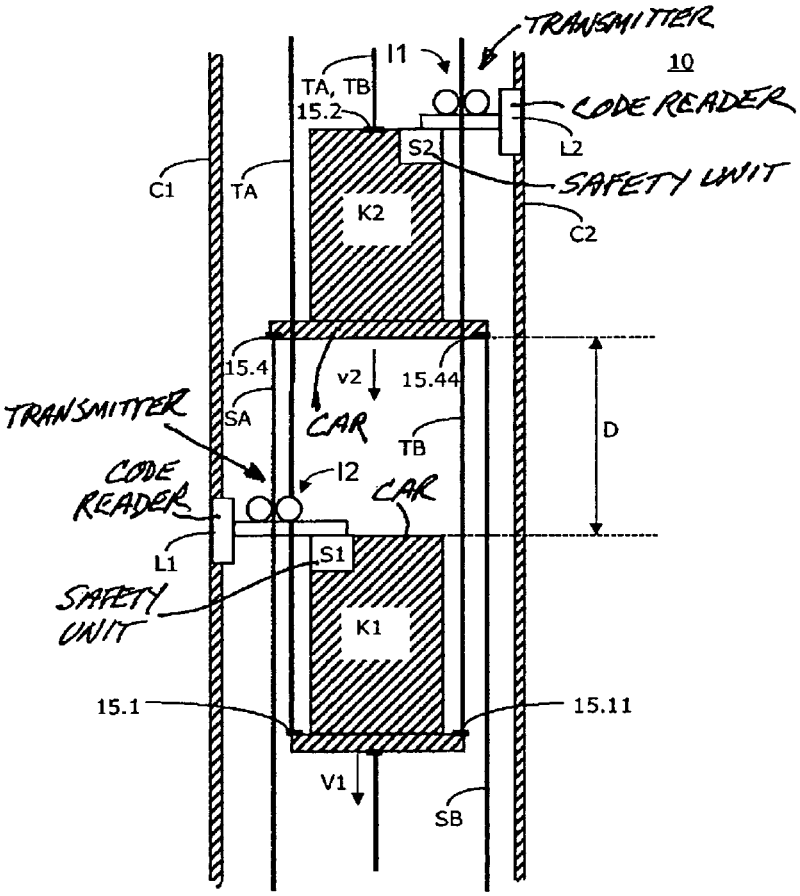
FIG. 3 shows a schematic illustration of a part of an elevator system according to the invention, from the side.

A part region of an elevator system 10 according to the invention is shown in FIG. 3. This is a side view which is turned through 90 degrees relative to the views of FIGS. 1 and 2. The elevator system 10 comprises a lower elevator car K1, an upper elevator car K2 and at least one counterweight 12 (not shown). Support means TA, TB for supporting the lower and upper elevator cars K1, K2 are provided, wherein the support means TB for supporting the lower elevator car K1 are led downwardly in the elevator shaft laterally along the upper elevator car K2 (the walls of the elevator shaft are not shown in these illustrations). In addition, drive means for individual driving of the lower and upper elevator cars K1, K2 are provided, but not shown. The upper elevator car K2 and the lower elevator car K1 move vertically in the common elevator shaft independently of one another. Moreover, the elevator system 10 comprises means for controlling the spacing D between the lower and upper elevator cars K1, K2. These means comprise vertically extending code strips C1, C2 fastened in the elevator shaft. A first code reader L1 is seated on the lower elevator car K1 and a second code reader L2 on the upper elevator car K2.

The code strips C1, C2 preferably have absolute positional information or codes, which make it possible for the elevator cars K1, K2 to make a statement about the absolute position on the elevator shaft.

Figure 4A:
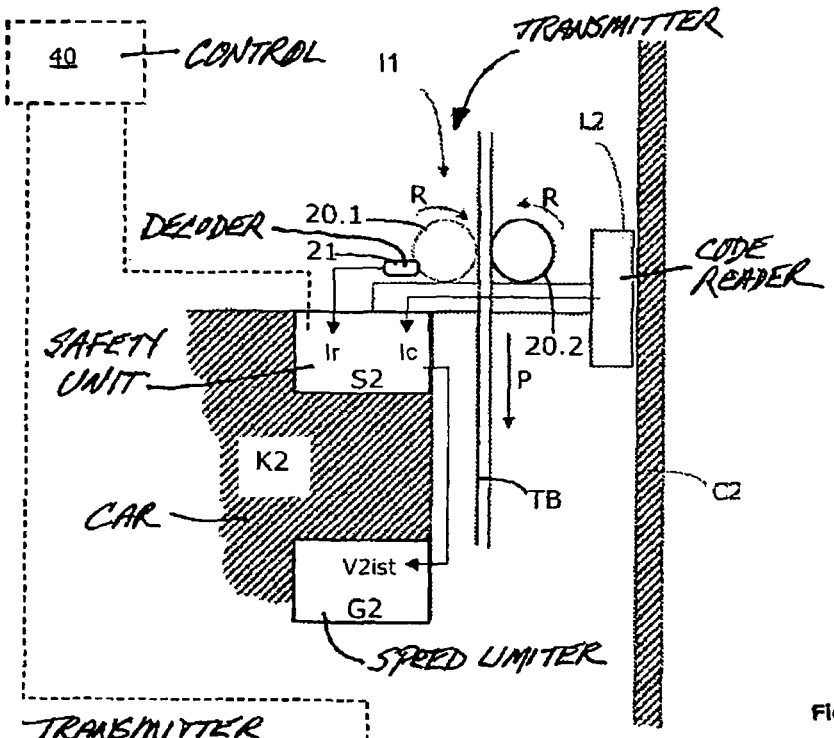
FIG. 4A shows a schematic illustration of the upper elevator car of the elevator system according to FIG. 3, from the side.

The upper elevator car K2 comprises at least one lower cable SA, SB which is suspended laterally at the upper elevator car K2 (at fastening points 15.4, 15.44) and which is led downwardly in the elevator shaft laterally along the lower elevator car K1. A first incremental transmitter I1, which interacts with a support means TB for supporting the lower car K1, is arranged at the upper elevator car K2. The first incremental transmitter I1 supplies information Ir (see FIG. 4A) which allows a statement about a change in the spacing D between the lower and upper elevator cars K1, K2. The information Ir is supplied to the upper elevator car K2, preferably to a safety unit S2, as indicated in FIG. 4A.

A second incremental transmitter I2, which interacts with a lower cable SA of the upper elevator car K2, is arranged at the lower elevator car K1. The second incremental transmitter I2 supplies information Ir (see FIG. 4B) which allows a statement about a change in the spacing D between the lower and upper elevator cars K1, K2. The information Ir is supplied to the lower car K1, preferably to a safety unit S1, as indicated in FIG. 4B.

Thus, each of the elevator cars K1, K2 is in a position of ascertaining the absolute position (L1*ist*, L2*ist*) and speed (V1*ist*, V2*ist*), which is made possible by the code readers L1, L2 and code strips C1, C2. In addition, each of the elevator cars K2 can ascertain the 'movement behavior' of the respective other elevator car K2, K1 in that it observes, by means of the incremental transmitter I1 or I2, the movement of the support means TB or lower cable SA of the other elevator car K2, K1.

Through the observation or detection of the 'movement behavior' of the respective other elevator car it is possible, for example, to determine the relative speed ($|V1ist-V2ist|$) between the two elevator cars K1, K2 or the change in spacing D(t) (spacing as a function of time t).

Figure 4B:
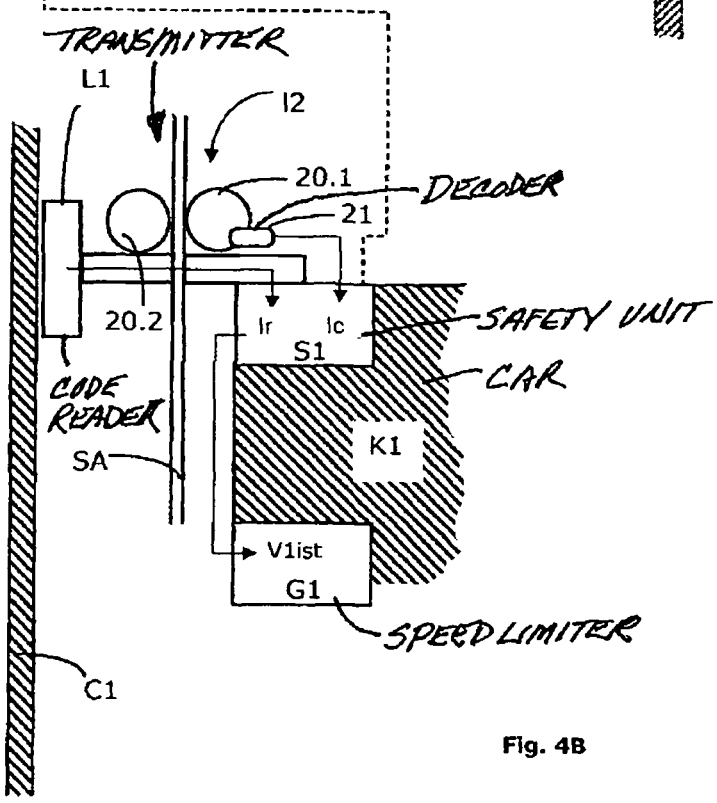
FIG. 4B shows a schematic illustration of the lower elevator car of the elevator system according to FIG. 3, from the side.

By way of the data, which are denoted in FIGS. 4A and 4B by Ic and Ir, each elevator car K1, K2 can make decisions and, for example, trigger braking by way of a speed limiter G1 or G2.

It can be seen in FIGS. 3, 4A and 4B that a code strip C1, C2 is provided for each elevator car K1, K2. However, it is possible for the two elevator cars K1, K2 to access the same code strip. In this case only one code strip C1 or C2 is present.

The code readers L1, L2 contactlessly scan the respective code strips C1, C2. The scanning is preferably carried out optically or magnetically. The first code reader L1 supplies information Ic to a first safety unit S1 which is arranged in or at the first elevator car K1. The information Ic allows a statement about the instantaneous absolute position L1*ist* and the instantaneous speed V1*ist* of the lower elevator car K1.

The second code reader L2 supplies the second safety unit S2 with information Ic about the instantaneous absolute position L2*ist* and the instantaneous speed V2*ist* of the upper elevator car K2.

As indicated in FIGS. 4A and 4B the lower elevator car K1 comprises a first safety unit S1 which receives or evaluates information Ic from the first code reader L1 and information Ir from the second incremental transmitter I2 of the lower elevator car K1. In FIG. 4B it is correspondingly indicated in schematic manner that a first speed limiter G1 (preferably an electronic speed limiter) is provided at the lower elevator car K1, which receives information V1*ist* about the instantaneous speed of the lower elevator car K1. If this instantaneous speed V1*ist* lies above a preset value (called Vmax) then a speed limitation or braking or emergency braking can be triggered.

The upper elevator car K2 comprises a second safety unit S2 (see FIG. 4A), wherein the second safety unit S2 receives or evaluates information Ic from the second code reader L2 and information Ir from the first incremental transmitter I1 of the upper elevator car K2. In FIG. 4A it is correspondingly indicated in schematic manner that a second speed limiter G2 (preferably an electronic speed limiter), which receives information V2*ist* about the instantaneous speed of the upper elevator car K2, is provided at the upper elevator car K2. If this instantaneous speed V2*ist* lies above a preset value (called Vmax) then a speed limitation or a braking or an emergency braking can be triggered.

It can be seen by way of FIGS. 4A and 4B that the incremental transmitters I1, I2 each comprise at least one roller 20.1, 20.2 which interacts with the support means TB or lower cable SA running past. The rollers 20.1, 20.2 are preferably friction wheels which can be set into rotation by the respective support means TB, which is running past, for supporting the lower elevator car K1 or by the lower cable SA of the upper elevator car K2.

A decoder 21, preferably an angle decoder, is provided at or near at least one of the rollers 20.1, 20.2, the decoder detecting rotations of the roller 20.1, 20.2 and transmitting corresponding information Ir to the respective safety unit S1, S2 of the respective elevator car K1, K2. According to the invention a vertical movement P (see FIG. 4A), for example of the support means TB, is converted into a rotational movement R of the rollers 20.1, 20.2. The rotational movement R of the roller 20.1 generates (angle) pulses, which, for example, can be counted or otherwise evaluated, in a decoder 21.

When the elevator installation 10 is placed in operation or after maintenance of an elevator installation preferably a memory (for example a register) in the first safety unit S1 is reset to zero, in accordance with one of the illustrations 3, 4A, 4B. If now the lower cable SA of the lower elevator car K2 moves past the incremental transmitter I2, then the safety unit S1 counts or ascertains the increments and files these values or this value in the memory. Through reading out the memory, data about the relative spacing D(t) at the time instant t is always present at the safety unit S1. The information in the memory can always be written over by new information. If the information Ir is evaluated with respect to a time basis t, then a statement can be made about the relative speed $v1(t)-v2(t)$.

The code reader L1 simultaneously supplies, but independently of the incremental transmitter I2, information Ic about the absolute position L1*ist* and, in a preferred form of embodiment, also about the instantaneous speed V1*ist* in the elevator shaft.

In a preferred form of embodiment the following information is present at the safety unit S1:

absolute position L1*ist*, relative spacing D(t), and relative speed $v1(t)-v2(t)$.

On the basis of this and optionally further information and with consideration of predeterminable rules (or algorithms) the safety unit S1 can place the 'movement behavior' of the lower elevator car K1 in relation to the 'movement behavior' of the upper elevator car K2. It is possible to make decisions on the basis of rules (or algorithms) and to trigger reactions. Thus, for example, the speed of the lower elevator car K1 can be reduced by means of the speed limiter G1, which is established there, if V1*ist*>Vmax.

According to the invention the safety unit S2 of the upper elevator car K2 is in a position of autonomously ascertaining the relative speed $v1(t)-v2(t)$ by observation of the support means TB running past. The safety unit S2 can, by means of the code reader L2 and the interaction (scanning process) of the code strip C2, on the one hand ascertain the absolute position L2*ist* and, in a preferred form of embodiment, also the actual speed $v2(t)=V2ist$. The current speed $v1(t)$ of the lower elevator car K1 can be ascertained, for example in the upper elevator car K2, from the relative speed $v1(t)-v2(t)$ and the knowledge of the own speed $v2(t)$.

According to the invention the safety unit S1 of the lower elevator car K1 is in a position of autonomously ascertaining the relative speed v2(*t*)−v1(*t*) by observation of the lower cable SA running past. By means of the code reader L1 and the interaction (scanning process) of the code strip C1 the safety unit S1 can on the one hand ascertain the absolute position L1*ist* and, in a preferred form of embodiment, also the own speed v1(*t*)=V1 ist. The current speed v2(*t*) of the upper elevator car K2 can be ascertained, for example in the lower elevator car K1, from the relative speed v2(*t*)−v1(*t*) and the knowledge of the own speed v1(*t*).

According to the invention the safety units S1, S2 are autonomous in the sense that they are not referred to data, which are received by way of a communications connection, from the respective other safety unit. This has the advantage that no communication connections between the elevator cars K1, K2 are needed.

Through the counting or detection of the increments (the corresponding increment values can be filed in a memory, as described) the respective other elevator car can make a statement about the instantaneous spacing D. Thus, depending on the respective translation ratio, for example, 1,000 increments correspond with a distance of 1 meter. If the value 10,000 is filed in the memory of the safety unit S2, then the current spacing D is approximately 10 meters.

Since each of the elevator cars K1, K2 can independently determine the own absolute position L1*ist* or L2*ist* by way of the code reader L1, L2, the respective position of the other elevator car K2, K1 can be calculated by computer with consideration of the stored increment value.

In analogous manner each of the elevator cars K1, K2 can also make, by computer, a statement about the speed v2(*t*), v1(*t*) of the respective other elevator car K2, K1. This possible, since the elevator car K1 knows, for example, the own absolute speed v1(*t*)=V1 ist and the relative speed v2(*t*)−v1 (*t*).

The second safety unit S2 can be designed analogously to the first safety unit S1. When placing an elevator installation 10 in operation or after maintenance of an elevator installation 10 preferably a memory (for example a register) in the second safety unit S2 is reset to zero according to one of the illustrations 3, 4A, 4B. If now the support means TB of the other elevator car K1 moves past the incremental transmitter I1 then the safety unit S2 counts or determines the increments and files these values or this value in the memory. Through reading out the memory, information about the relative spacing D(t) at the time instant t is present at the safety unit S2. The information in the memory can always be written over by new information. If the information Ir is evaluated with reference to a time basis t, then a statement about the relative speed v2(*t*)−v1(*t*) can be made. By way of this information and with consideration of predeterminable rules (or algorithms) the safety unit S2 can always set the 'movement behavior' of the upper elevator car K2 in relation to the 'movement behavior' of the lower elevator car K1. Decisions can be made on the basis of rules (or algorithms) and reactions triggered. Thus, for example, the speed of the upper elevator car K2 can be reduced by means of the speed limiter G2, which is established there, if V2*ist*>Vmax.

According to a further form of embodiment of the invention a laser distance measuring device 30 is provided for each elevator car K1, K2 in order to be able to measure the spacing D from the respective other elevator car K2, K1 and/or the spacing from a shaft end. These laser distance measuring devices 30 supply information which in part is redundant with the information Ir, Ic supplied by the incremental transmitters I1, I2 and/or the code readers L1, L2. The form of embodiment shown in FIG. 5 allows a statement about the absolute distance D between the two elevator cars K1, K2 and/or a statement about the absolute distance from the shaft base or from the upper shaft end, depending on where the laser distance measuring device 30 is arranged at the respective elevator car. The safety of the elevator installation 10 is further increased by the use of the laser distance measuring device 30.

A laser distance measuring device 30 can be seated at, for example, the upper region of the lower elevator car K1, and transmit a light beam to the upper elevator car K2, which beam is reflected there and further intercepted by the laser distance measuring device 30 and evaluated. A further laser distance measuring device 30 can be seated at the lower region of the upper elevator car K2 and transmit a light beam to the lower elevator car Kt which beam is reflected there and further intercepted by the laser distance measuring device 30 and evaluated.

The safety units S1, S2 can be of digital construction and the corresponding decision and evaluation structures can be realized by means of software. However, it is also possible to provide corresponding logic circuits.

In a preferred form of embodiment each of the safety units S1, S2 is connected by way of a co-running cable with a central elevator control 40, as indicated in FIGS. 4A and 4B by two dotted lines (communications connections).

in a further preferred form of embodiment each elevator car K1, K2 can autonomously detect the spacing from the respective other elevator car K2, K1 and trigger an emergency braking if a safety spacing Dkrit is fallen below. The triggering of an emergency braking can additionally also take into consideration information about the speed of the elevator cars K1, K2. If the elevator cars K1, K2 move towards one another at greater speed and the safety spacing Dkrit is fallen below it is possible, for example, to carry out a stronger braking maneuver.

It is an advantage of the invention that the two elevator cars K1, K2 are movable independently of one another. This is possible particularly by a redundant and mutually independent architecture of the safety units S1, S2 as well as of the means I1, L2, or I2, L1 and 30.

Figure 6:
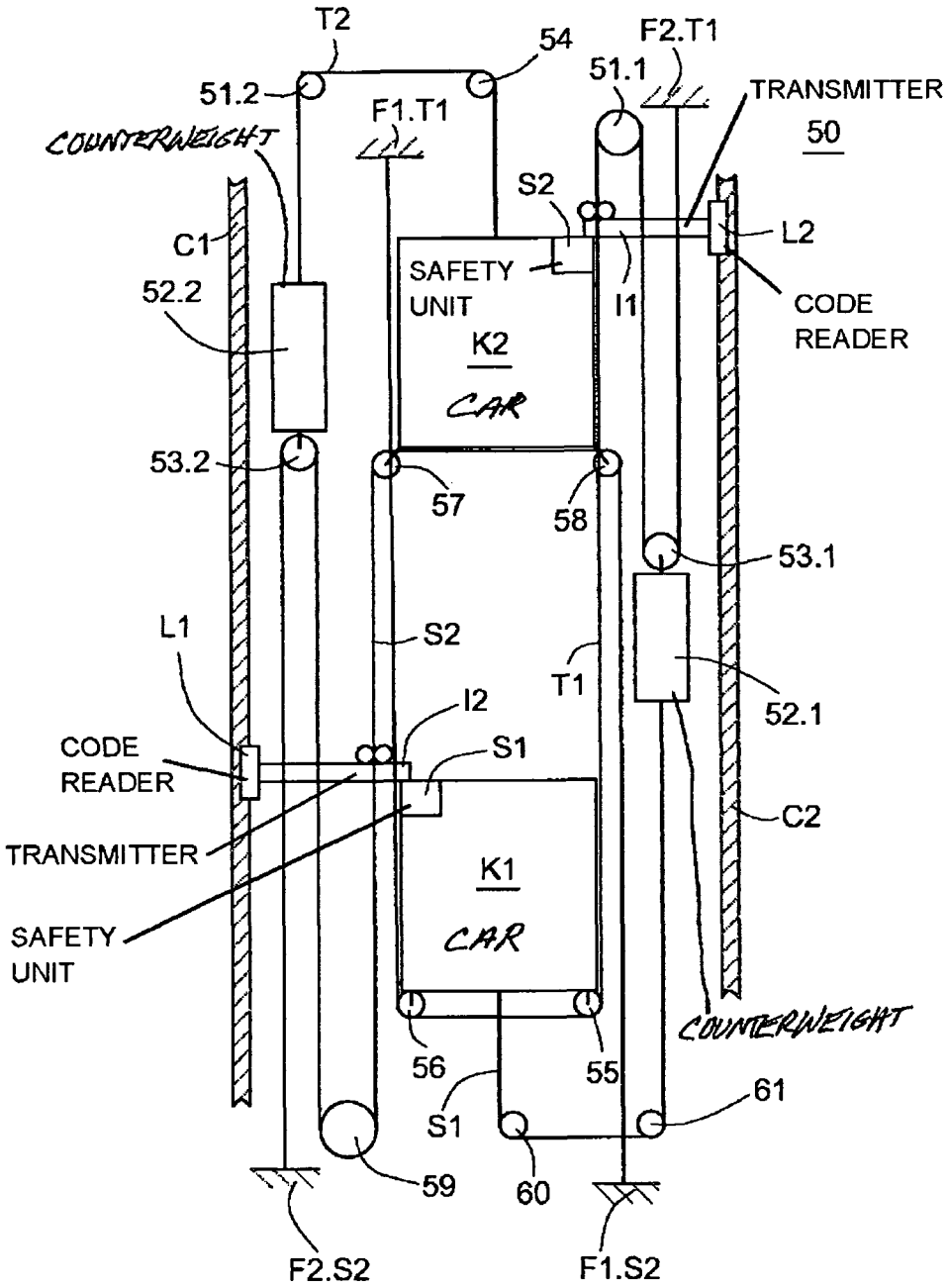
FIG. 6 shows a third elevator system according to the invention, with lower cables.

In a further example of embodiment according to the FIG. 6 a fourth elevator system 50 comprises two elevator cars K1, K2, with each of which a respective counterweight 52.1, 52.2 is associated, In such an arrangement, for example, the upper elevator car K2 is suspended centrally at one end of a first support means T2 in 1:1 relationship. The associated counterweight 52.2 is suspended at the second end of the support means T2 similarly in 1:1 relationship and is positioned laterally between the upper elevator car K2 and a shaft wall (not shown). The support means T2 is guided between the upper elevator car K2 and the counterweight 52.2 by a deflecting roller 54 and a drive pulley 51.2, which each lie vertically above the elevator car K2 and the counterweight 52.2.

The lower elevator car K1 is suspended at a second support means T1 in 2:1 relationship. The associated counterweight 52.1 is suspended at the same support means T1 similarly in 2:1 relationship and is positioned laterally between the lower elevator car and a second shaft wall (not shown) opposite the counterweight 52.2 associated with the upper elevator car K2. The support means T1 of the lower elevator car K1 is guided downwardly from a first cable fixing point F1.T1 in the upper region of the elevator shaft laterally along a first car side of the upper elevator car K2 to the lower elevator car K1, deflected there at two car deflecting rollers 55, 56 through a total of 180° and again led laterally along a second car side, which is opposite the first car side of the upper elevator car K2, in upward direction to a further drive pulley 51.1. This drive pulley 51.1 deflects the support means T1 through 180° downwardly to the associated counterweight 52.1. Finally, the support means T1 is guided through a further 180° by an upper counterweight deflecting roller 53.1 in the upper region of the counterweight 52.1 to a second cable fixing point F2.T1, which is located in the upper region of the elevator shaft.

The upper elevator car K2 preferably has a lower cable S2, which is fastened by a first end in the lower region of the elevator shaft at a cable fixing point F1.52. This cable fixing point F1.S2 lies laterally offset below the projection of the counterweight 52.1 of the lower elevator car K1. The lower cable S2 is then led, starting from the first cable fixing point F1.S2, laterally along a first car side of the lower elevator car K1 to two car deflecting rollers 57, 58, which are mounted in the lower region of the upper elevator car K2. The lower cable S2 is deflected through a total of 180° at the two car deflecting rollers 57, 58 and again led laterally along a second car side of the lower elevator car K1 downwardly to a deflecting roller 59 in the lower region of the elevator shaft. This deflecting roller 59 deflects the lower cable 52 through 180° upwardly to a counterweight deflecting roller 53.2, which is located in the lower region of the associated counterweight 52.2. The lower cable S2 is again deflected downwardly through 180° at this counterweight deflecting roller 53.2 and led into the lower region of the elevator shaft. Finally, the lower cable S2 is fastened at a second end to a further cable fixing point F1.S2.

The lower elevator car K1 and the associated counterweight 52.1 are tensioned by means of a further lower cable S1. The lower cable S1 is fastened at a first end on the underside of the lower elevator car K1 and at a second end on the underside of the associated counterweight 52.1. In addition, two further deflecting rollers 60, 61 are positioned in the lower region of the elevator shaft for guidance of the lower cable S1 between the lower elevator car K1 and the counterweight 52.1.

Figure 5:
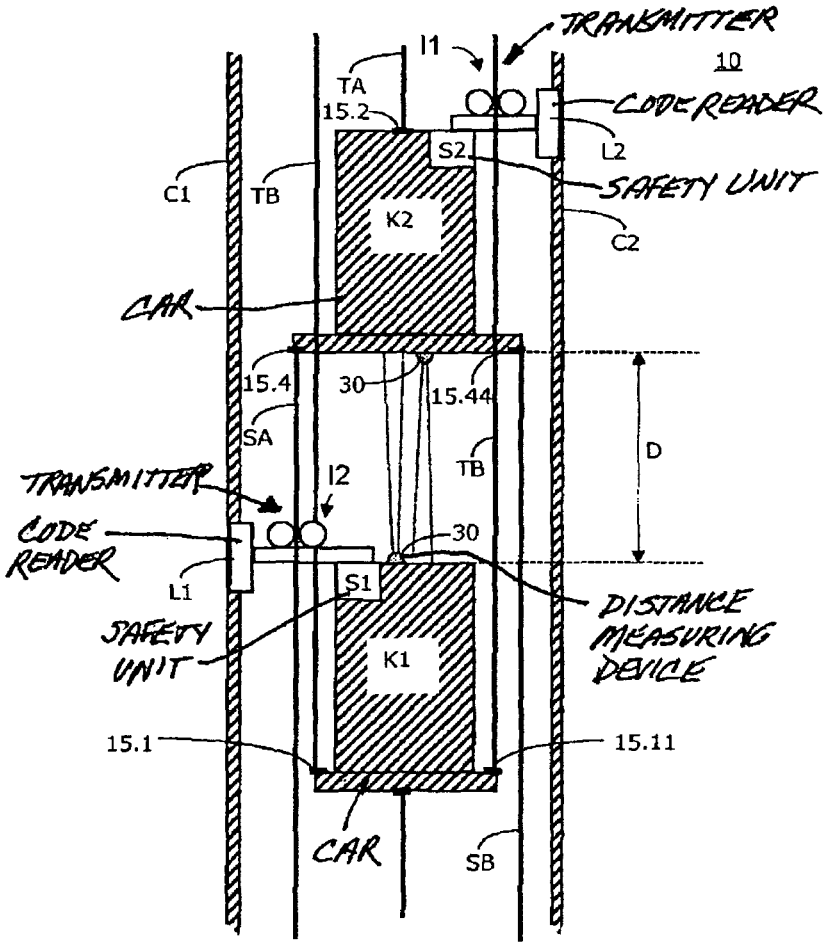
FIG. 5 shows a schematic illustration of a part of further elevator system according to the invention, from the side.

All exemplifying embodiments shown in FIGS. 3 to 5 and descriptions are, in principle, also usable for the fourth elevator system 50. However, with respect to the information Ir of the incremental transmitters I1, I2 it is necessary to note the following for suspension relationships of the support means or lower cable S2, which run past, differing from 1:1.

In order in the example of embodiment according to FIG. 6 to make a conclusion about the movement state of the respective adjacent elevator car K1, K2, a safety unit S1 has available, for example, the following data:

absolute position L1*ist* absolute speed v1*ist* relative spacing D(t)* relative speed v1(*t*)*v2(*t*)* suspension ratio of the lower cable S2 relative to the upper elevator car K2.

On the basis of these and optionally further data and with consideration of predeterminable rules (or algorithms), the safety unit S1 of the lower elevator car K1 is here, too, in a position of autonomously determining the relative speed v1(*t*)−v2(*t*) by observing the lower cable S2 running past. The measured relative spacing D(t)* is to be understood as length of the lower cable S2 running past per time unit and the relative speed v1(*t*)*−v2(*t*)* derived therefrom. Since the lower cable S2 with the adjacent elevator car K2 is suspended 2:1, the measured relative spacing D(t)* corresponds, on the basis of the information Ir, only exceptionally with the actual relative spacing D(t) between the elevator cars K1, K2. The safety unit S1 thus calculates on the basis of the above data, particularly also the suspension relationship, differing from 1:1, the actual relative spacing D(t) or the actual relative speed v1(*t*)−v2(*t*).

The above explanations are also applicable to the upper elevator car K2, particularly to the observation of the support means T1 running past and to the calculation of the actual relative spacing D(t) or the actual relative speed v1(*t*)−v2(*t*).

According to the invention the safety unit S2 of the upper elevator car K2 is in a position of autonomously determining the relative speed v1(*t*)−v2(*t*) by observation of the support means T1 running past. By means of the code reader L2 and the interaction (scanning process) of the code strip C2 the safety unit S2 can on the one hand determine the absolute position L2*ist* and, in a preferred form of embodiment, also the own speed v2(*t*)=V2*ist*. The current speed v1(*t*) of the lower elevator car K1 can be ascertained, for example in the upper elevator car K2, from the calculated relative speed v1(*t*)−v2(*t*) and the knowledge of the own speed v2(*t*).

According to the invention the safety unit S1 of the lower elevator car K1 is in a position of autonomously determining the relative speed v2(*t*) (t) by observation of the lower cable SA running past. By means of the code reader L1 and the interaction (scanning process) of the code strip C1 the safety unit S1 can on the one hand determine the absolute position L1*ist* and, in a preferred form of embodiment, also the own speed v1(*t*)=Vlist. The current speed v2(*t*) of the upper elevator car K2 can be determined, for example in the lower elevator car K1, from the calculated relative speed v2(*t*)−v1(*t*) and the knowledge of the own speed v1(*t*).

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system having a first elevator car, a second elevator car, at least one counterweight, a first tension means connected to the first elevator car and which is led laterally along the second elevator car, drive means for driving the first and second elevator cars, and a common elevator shaft in which the second elevator car and the first elevator car vertically move independently of one another, comprising:

a first incremental transmitter arranged at the second elevator car for interacting with the first tension means and supplying to a safety unit of the second elevator car information about a change in a spacing between the first and second elevator cars wherein the safety unit controls the movement of the second elevator car in response to the information from the first incremental transmitter.

2. The elevator system according to claim 1 including a second tension means connected to the second elevator car and which is led laterally along the first elevator car, and a second incremental transmitter arranged at the first elevator car for interacting with the second tension means and supplying to a safety unit of the first elevator car information about a change in the spacing between the first and second elevator cars wherein the safety unit of the first elevator car controls the movement of the first elevator car in response to the information from the second incremental transmitter.

3. The elevator system according to claim 2 wherein said first and second incremental transmitters each include at least one roller set into rotation by the respective first tension means and the second tension means running past the second elevator car and the first elevator car respectively.

4. The elevator system according to claim 3 including a decoder at said at least one roller, said decoder detecting rotation of said at least one roller and transmitting corresponding information to the safety unit of a respective one of the first and second elevator cars.

5. The elevator system according to claim 2 including means for controlling the spacing between the first and second elevator cars, said means for controlling including at least one vertically extending code strip fastened in the elevator shaft, a first code reader at the first elevator car for reading said at least one code strip and a second code reader at the second elevator car for reading said at least one code strip.

6. The elevator system according to claim 5 wherein said first elevator car safety unit obtains information from said first code reader and information from said second incremental transmitter and said second elevator car safety unit obtains information from said second code reader and information from said first incremental transmitter.

7. The elevator system according to claim 1 wherein the first elevator car is suspended at two separate mutually opposite fastening regions to be laterally balanced.

8. The elevator system according to claim 1 wherein the second elevator car is suspended in a central upper fastening region at an end of the first tension means.

9. The elevator system according to claim 1 including a code strip associated with each of the first and second elevator cars, and a pair of code readers each for contactlessly scanning an associated one of said code strips, wherein a first one of said code readers supplies the first elevator car safety unit with information about an instantaneous absolute position and an instantaneous speed of the first elevator car and wherein a second one of said code readers supplies the second elevator car safety unit with information about an instantaneous absolute position and an instantaneous speed of the second elevator car.

10. The elevator system according to claim 9 including a first speed limiter controllable by said first elevator car safety unit and positioned at the first elevator car, wherein said first elevator car safety unit triggers said first speed limiter if the instantaneous speed of the first elevator car falls below a maximum permissible limit value and a second speed limiter controllable by said second elevator car safety unit and positioned at the second elevator car, wherein said second elevator car safety unit triggers said first speed limiter if the instantaneous speed of the second elevator car falls below the maximum permissible limit value.

11. The elevator system according to claim 1 including a laser distance measuring device provided at each of the first and second elevator cars each for measuring the spacing from the respective other of the first and second elevator car or a spacing from a shaft end.

12. The elevator system according to claim 1 wherein the first tension means is a support means for supporting the first and second elevator cars and including at least one support means for supporting the first elevator car and which is led downwardly in the elevator shaft laterally along the second elevator car, and the second tension means is a lower cable for tensioning the second elevator car and which is led downwardly in the elevator shaft laterally along the first elevator car.

13. The elevator system according to claim 1 wherein the first elevator car and the second elevator car are vertically arranged with the first elevator car below the second elevator car.

14. An elevator system comprising:

a first elevator car;

a second elevator car positioned above said first elevator car, said first elevator car and said second elevator car vertically moving independently of one another in a common elevator shaft;

a first support means connected to said first elevator car for supporting said first elevator car and which is led laterally along said second elevator car; and a first incremental transmitter arranged at said second elevator car for interacting with said first support means and supplying to a safety unit of said second elevator car information about a change in a spacing between said first and second elevator cars wherein said safety unit controls the movement of said second elevator car in response to the information from said first incremental transmitter.

15. The elevator system according to claim 14 including a first lower cable connected to said second elevator car for tensing said second elevator car and which is led laterally along said first elevator car, and a second incremental transmitter arranged at said first elevator car for interacting with said first lower cable and supplying to a safety unit of said first elevator car information about a change in the spacing between said first and second elevator cars wherein said first elevator car safety unit controls the movement of said first elevator car in response to the information from said second incremental transmitter.

16. The elevator system according to claim 15 wherein said first and second incremental transmitters each include at least one roller set into rotation by the respective first tension means and the second tension means running past said second elevator car and said first elevator car respectively.

17. The elevator system according to claim 16 including a decoder at said at least one roller, said decoder detecting rotation of said at least one roller and transmitting corresponding information to a said safety unit of a respective one of said first and second elevator cars.

18. The elevator system according to claim 14 including a code strip associated with each of said first and second elevator cars, and a pair of code readers each for contactlessly scanning an associated one of said code strips, wherein a first one of said code readers supplies said first elevator car safety unit with information about an instantaneous absolute position and an instantaneous speed of said first elevator car and wherein a second one of said code readers supplies the second elevator car safety unit with information about an instantaneous absolute position and an instantaneous speed of said second elevator car.

19. The elevator system according to claim 18 including a first speed limiter controllable by said first elevator car safety unit and positioned at said first elevator car, wherein said first elevator car safety unit triggers said first speed limiter if the instantaneous speed of said first elevator car falls below a maximum permissible limit value and a second speed limiter controllable by said second elevator car safety unit and positioned at said second elevator car, wherein said second elevator car safety unit triggers said first speed limiter if the instantaneous speed of said second elevator car falls below the maximum permissible limit value.

20. The elevator system according to claim 14 including a laser distance measuring device provided at each of said first and second elevator cars each for measuring the spacing from the respective other of said first and second elevator cars or a spacing from a shaft end.

* * * * *